US011118310B2

(12) United States Patent
Boegershausen

(10) Patent No.: US 11,118,310 B2
(45) Date of Patent: Sep. 14, 2021

(54) DRYING HOOD, DRYING ARRANGEMENT AND USE THEREOF

(71) Applicant: VOITH PATENT GMBH, Heidenheim (DE)

(72) Inventor: Andreas Boegershausen, Willich (DE)

(73) Assignee: Voith Patent GmbH, Heidenheim (DE)

( * ) Notice: Subject to any disclaimer, the term of this patent is extended or adjusted under 35 U.S.C. 154(b) by 106 days.

(21) Appl. No.: 16/487,285

(22) PCT Filed: Feb. 8, 2018

(86) PCT No.: PCT/EP2018/053147
§ 371 (c)(1),
(2) Date: Aug. 20, 2019

(87) PCT Pub. No.: WO2018/149722
PCT Pub. Date: Aug. 23, 2018

(65) Prior Publication Data

US 2019/0368127 A1 Dec. 5, 2019

(30) Foreign Application Priority Data

Feb. 20, 2017 (DE) ..... 10 2017 103 422.6

(51) Int. Cl.

| | |
|---|---|
| ***F26B 11/02*** | (2006.01) |
| ***D21F 5/04*** | (2006.01) |
| ***D21F 5/00*** | (2006.01) |
| ***D21F 5/14*** | (2006.01) |
| ***D21F 5/18*** | (2006.01) |
| *F26B 21/00* | (2006.01) |

(52) U.S. Cl.
CPC ..... *D21F 5/044* (2013.01); *D21F 5/004* (2013.01); *D21F 5/143* (2013.01); *D21F 5/181* (2013.01); *D21F 5/182* (2013.01); *F26B 21/004* (2013.01)

(58) Field of Classification Search
CPC ..... D21F 5/044; D21F 5/004; D21F 5/143; D21F 5/181; D21F 5/182; F26B 21/004
USPC ..... 34/603, 132, 130, 117
See application file for complete search history.

(56) References Cited

U.S. PATENT DOCUMENTS

| | | | |
|---|---|---|---|
| 5,410,819 | A | 5/1995 | Joiner |
| 5,531,033 | A | 7/1996 | Smith et al. |
| 7,363,725 | B2 | 4/2008 | Promitzer et al. |

(Continued)

FOREIGN PATENT DOCUMENTS

| | | | |
|---|---|---|---|
| AT | 411274 | B | 11/2003 |
| EP | 1347096 | A2 | 9/2003 |

*Primary Examiner* — John P McCormack
(74) *Attorney, Agent, or Firm* — Laurence A. Greenberg; Werner H. Stemer; Ralph E. Locher

(57) ABSTRACT

A drying hood for drying a fibrous web, such as a tissue paper web, includes a plurality of nozzle boxes for supplying or discharging air and a housing that at least partially surrounds the nozzle boxes. The nozzle boxes are each individually mounted on the housing by a first bearing and a second bearing. The two bearings allow at least one movement of the nozzle box relative to the housing along a longitudinal axis of the nozzle box and/or at least one movement in a direction transverse thereto, along a transverse axis of the nozzle box. The two bearings have translational degrees of freedom differing by one. A drying arrangement having a drying cylinder and the drying hood is also provided.

18 Claims, 2 Drawing Sheets

(56) References Cited

U.S. PATENT DOCUMENTS

| | | | | |
|---|---|---|---|---|
| 2003/0177660 | A1* | 9/2003 | Promitzer | D21F 5/181<br>34/623 |
| 2005/0056393 | A1* | 3/2005 | Reisinger | D21F 5/042<br>162/290 |

* cited by examiner

DRYING HOOD, DRYING ARRANGEMENT AND USE THEREOF

BACKGROUND OF THE INVENTION

Field of the Invention

The invention relates to a drying hood, a drying arrangement comprising such a hood, and the use of the drying hood in such a drying arrangement.

Moist or wet fibrous webs, such as paper or cardboard webs, are dried using drying arrangements in drying sections of machines, such as paper or cardboard production machines. Convection and/or radiant heat is supplied to dry the fibrous web. Typically, the fibrous web is guided along a part of the outer circumference of one or more heated or heatable drying cylinders.

The liquid contained in the fibrous web evaporates as a result of the fibrous web contacting at least one drying cylinder. This liquid is discharged by suction via a drying hood arranged above the drying cylinder. The resulting exhaust air has high moisture levels or humidity. The suctioned air is replaced by the continuous supply of comparatively dry and hot supply air.

Drying hoods comprise a plurality of nozzle boxes. Each nozzle box has a multiplicity of outlet openings for the supply air for drying the fibrous web. The nozzle boxes are arranged inside the housing of the drying hood and are aligned in such a way that their outlet openings point toward the outer circumference of the drying cylinder, i.e. toward the fibrous web that will be dried. Put differently, when the drying hood is in operation, the nozzle boxes are arranged between the housing of the drying hood and the fibrous web to be dried. The nozzle boxes are located directly opposite the fibrous web. In addition, adjacent nozzle boxes may combine to either limit or create suction openings for the exhaust air. The nozzle boxes are part of an air routing system of the drying hood. The air routing system has at least one supply duct for the supply air, which is connected to the individual nozzle boxes in a flow-conducting manner—preferably via corresponding distribution ducts. Moisture-laden exhaust air is discharged from the drying hood, or more precisely from the gap that separates the drying hood from the outer surface of the drying cylinder, via the suction openings that are arranged between or formed by the nozzle ducts. For this purpose, in order to suction the exhaust air from the drying hood, the suction openings are connected to a flow-conducting exhaust duct via corresponding suction ducts in order to suction the exhaust air from the drying hood. The drying hood or drying arrangement is accordingly associated with corresponding devices (for example for blowing, suctioning, heating, etc.) for conveying and preparing the air. The air routing system made up of the distribution, supply and exhaust ducts may be arranged partially or completely the housing of the drying hood.

In principle, the hot, moisture-laden exhaust air may feasibly be between approx. 150° C. and 500° C. The temperature difference between the supply air and exhaust air may range between 50 and 250 K.

The invention relates to the aforementioned subject matter.

Due to these comparatively high temperature differences, the components inside the drying hood that the supply and exhaust air circulate or flow against are also subjected to different thermal loads. The components may therefore expand to different extents while the drying hood is operating. This expansion leads to thermally-induced stresses within these components. Because the drying hood serves as a support structure for the components arranged inside it, these stresses are transferred to the drying hood. Thus, during operation these components may be subject to undesired mechanical tensions, deformations or even damage.

To eliminate this problem, structures are known in the art that compensate for a thermally-induced elongation of the nozzle boxes while the drying arrangement is operating. For example, the nozzle boxes are respectively bonded to the drying hood at both of their longitudinal ends by means of elastic metal clamps, for example by welding. As a result, the nozzle boxes are first firmly clamped at their two longitudinal ends. In the case of thermally induced elongation, the longitudinal ends of the expanding nozzle boxes press against the clamps in the direction of the longitudinal axis. The clamps yield accordingly, buckle and thus compensate for the elongation, to an extent corresponding to the displacement.

This solution has two drawbacks, however: In certain operating conditions, the direction of buckling cannot be predicted. This may cause the nozzle boxes to move toward the drying cylinder and damage it. During operation, this leads to damaging the drying cylinder and thus unplanned downtime of the entire machine. Additionally, such a structure requires that the clamps are welded on both sides to the inside of the drying hood during installation. The welding work must be carried out manually inside the drying hood. As a rule, prefabrication is not possible due to the limited space available inside the drying hood.

SUMMARY OF THE INVENTION

The invention is therefore based on the task of refining a drying hood of the above-mentioned type, so as to prevent distortion and deformation of the hood, which may lead to damage. In addition, the structure of such a system should be less complex and assembly should be facilitated by a high degree of prefabrication.

This object is accomplished by a drying hood as well as a drying arrangement and a use of the drying hood according to the features of the independent claims. The dependent claims relate to particularly preferred embodiments of the invention.

The inventor has recognized that disadvantageous stress conditions may be avoided by furnishing two bearings with different translational degrees of freedom, compared to the fixed clamping of the axial ends of the nozzle box during operation of the drying hood. In particular, in contrast to the case of fixed clamping with metal clamps, forces that exert a torsional load on the nozzle boxes may be selectively transferred to the drying hood, without stress or deformation, as a result of the interaction of the two bearings. By means of the bearings of the individual nozzle boxes according to the invention, the known drawbacks of the prior art may be avoided.

For the purpose of the invention, the term "nozzle box" means the above-defined object, which is part of a drying hood that is likewise described above.

According to the invention, the term "bearing" refers to a static element that establishes a connection between two elements, here the corresponding nozzle box and the housing of the drying hood, and transfers force magnitudes (forces and moments) that arise as a result of one of the two elements moving toward the respective other element.

References to a "degree of freedom" in the context of the invention denote a mechanical degree of freedom. A body that may move freely in space has a total of 6 degrees of freedom, specifically three translational and three rotational degrees of freedom. These degrees of freedom correspond to the three spatial axes of a Cartesian coordinate system. The bearings according to the invention are designed in such a way that they differ from one another by one with regard to their translational degrees of freedom. This means, for example, that the second bearing permits axial movement of the nozzle box relative to the drying hood (also referred to as longitudinal or linear movement) along two spatial axes; in contrast, the first bearing permits such an axial movement only with respect to one (single) spatial axis. In principle, the second bearing could conceivably allow (three) axial movements and the first bearing could allow (exactly) two axial movements. In principle, there could be such a difference of at least one degree of freedom so that the first bearing has a translational degree of freedom of (exactly) three and the second bearing has a translational degree of freedom of exactly one. If the bearings are arranged in the area of the axial ends of the respective nozzle box, the respective axial end of the respective nozzle box will have the corresponding degree of freedom of the bearing on which it is mounted.

For the purpose of this invention, movements of the nozzle box relative to the housing due to manufacturing tolerances that arise from the manufacture of the bearing (for example bearing clearance) are not regarded as (additional) degrees of freedom.

The definition of bearings according to the invention, with respect to the difference in translational degrees of freedom, may alternatively be described as follows if it is assumed that the first bearing has two degrees of freedom and the second bearing has one: The first bearing is designed as a doubly-displaceable bearing, configured so that it allows a displacement of the nozzle box relative to the housing along the longitudinal axis of the nozzle box and along a transverse axis perpendicular thereto. In contrast, the second bearing is designed as a singly-displaceable bearing, configured in such a way as to enable displacement of the nozzle box relative to the housing (only) along the transverse axis. This definition refers only to the aforementioned difference in translational degrees of freedom between the two bearings. Put differently, the first bearing allows linear displacement of the nozzle bar along its longitudinal and transverse axes, and the second bearing allows such a linear displacement relative to the drying hood only in the transverse direction of the nozzle bar.

In comparison, the above-mentioned fixed clamping forms a fixed bearing that at the outset prevents or inhibits all translational and rotational movements of the component connected to it. Such a fixed bearing thus has both a translational and a rotational degree of freedom of zero.

References to a "displaceable bearing" in the context of this invention signify that the bearing itself is not necessarily displaced, but that the bearing enables a corresponding movement or displacement (axial movement or linear movement) of the component mounted on this bearing in the corresponding spatial axis.

References to a bearing being "associated" with an object signify that this object is arranged locally at the bearing (in the vicinity of the bearing) or at an element that contributes to forming the bearing, such as the nozzle box or housing.

A "drying cylinder" refers to a heated or heatable roll that is driven during normal operation of the drying arrangement. The fibrous web to be dried may be guided indirectly onto its outer circumference. During operation, the drying cylinder rotates about its axis of rotation relative to the fixed drying hood. Such a drying cylinder may also be designed as a Yankee cylinder.

The longitudinal axis of the nozzle box describes the longitudinal extension of the nozzle box in space. This axis may also correspond to the longitudinal symmetry axis of the nozzle box. In space, the longitudinal axis may correspond to the X-axis of a Cartesian coordinate system. Once the drying hood has been installed in a drying arrangement according to the invention and the drying arrangement is in operation, the longitudinal axis is parallel to the machine transverse direction of the drying arrangement. The machine transverse direction corresponds to the width direction of the fibrous web to be dried. The machine transverse direction in the plane of the fibrous material is perpendicular to the machine direction, which determines the longitudinal direction, i.e. the running direction, of the fibrous web when it passes through the drying arrangement.

The transverse axis of the nozzle box is perpendicular to the longitudinal axis of the nozzle box. It describes the width extension of the nozzle box and may correspond to the Y-axis of a Cartesian coordinate system. The transverse axis may represent a transverse axis of symmetry of the respective nozzle box. When the drying hood in the drying arrangement is ready for operation, the nozzle boxes may be arranged on the outer circumference of the drying cylinder inside the drying hood. They may be arranged in such a way that their respective longitudinal axes run parallel to the axis of rotation of the drying cylinder. In addition, the nozzle boxes may be positioned within the drying hood in such a way that their respective transverse axes are parallel to a tangent to the casing (outer circumference) of the drying cylinder at the point where a perpendicular between the axis of rotation of the drying cylinder and the corresponding longitudinal axis of the nozzle bar intersects the casing of the drying cylinder. This is the case in a side view of the drying arrangement in the direction of the rotation axis of the drying cylinder. In this arrangement, the nozzle boxes and the drying cylinder are opposite each other so as to dry the fibrous web that the drying cylinder transports between them. The nozzle boxes form or bound a gap with the outer surface of the drying cylinder. On the side of the nozzle bar that faces the outer surface of the drying cylinder, there may be furnished outlet openings for supply air flowing to the drying hood and/or suction openings for exhaust air flowing from the drying hood.

For the purpose of the invention, a "fibrous web" is a fabric or scrim of fibers, such as wood fibers, plastic fibers, glass fibers, carbon fibers, additives, admixtures or the like. For example, the fibrous web may be a paper web, cardboard web or tissue web. The web may substantially comprise wood fibers, with small quantities of other fibers or additives and admixtures being present. This adaptation to a particular application is left to the skilled person.

Where reference is made in the invention to air, supply air or exhaust air, the definition of the same encompasses not only air but also an air-water mixture, such as aerosol or steam, and may in principle be at any temperature and any pressure.

"At least partially," for the purpose of the invention, means partially or completely.

If the drying hood is said to partially or completely surround the nozzle boxes, this means that the nozzle boxes are at least partially accommodated inside the housing.

If the nozzle boxes are said to be mounted individually (in the housing), this signifies that the nozzle boxes are furnished with such bearings independently of each other, i.e. separately. In other words, each individual nozzle box is arranged so as to be respectively movable in at least one linear direction, relative to the housing on which it is suspended, independently of the adjacent nozzle boxes. Put differently, a first bearing and a second bearing are respectively associated with the corresponding nozzle box.

If in the context of the invention the nozzle boxes are said to be mounted on the drying hood, this always refers to the housing of the drying hood.

The formulation "in the area of the axial ends of a nozzle box" refers to that area that is respectively located in the last third of the corresponding axial end of the nozzle box in relation to the direction of linear expansion, i.e. the longitudinal direction.

The housing of the drying hood may have one or more parts. In the case of multi-part housings, individual components may be prefabricated and assembled to form building components and then make up a corresponding part of the housing. In the final assembly, the individual parts are then assembled to form the complete housing. In this way the parts may be pre-assembled simply and safely. The necessary welding work does not have to be carried out within the drying hood on site, but instead may be carried out directly on a workbench.

The two bearings according to the invention may be designed in such a way that they are purely linear bearings. These bearings only allow linear movements and block rotations, and thus do not allow any rotational degrees of freedom. In such a case they are not designed as pivot bearings, and thus do not have any rotational degrees of freedom. Put differently, the rotational degree of freedom is zero. The bearings according to the invention could thus be designed in such a way that they have only translational degrees of freedom, i.e. they allow only one pure displacement or a plurality of displacements in a linear direction.

If the bearings are designed as guide rails, this has the advantage that such a bearing is comparatively simple to design and cost-effective to manufacture. If sliding bearings are also used, they may be operated reliably and with comparatively little maintenance, even at high temperatures.

In principle, at least one of the two bearings could potentially be designed as a deformable bearing, such as an elastomer bearing. Deformable bearings allow displacement or rotation of the mounted component not by a rigid, predetermined mechanics, such as for example the mechanics of a guide rail (solid body movement), but by deformation of the bearing itself—more precisely its material.

An arrangement of the two bearings such that the first bearing is located in the area of one axial end of the nozzle box and the second bearing is located in the area of the other axial end—relative to the longitudinal axis of the nozzle box—has advantages in terms of maintenance and assembly. The bearings are located closer to the drying hood and are therefore readily accessible from the outside if appropriate maintenance openings are provided in the drying hood.

This is even more the case if the bearings are arranged in the area of the end faces between the nozzle box and the housing of the drying hood.

The invention also relates to a drying arrangement for drying a fibrous web such as a tissue paper web, comprising a drying cylinder and a drying hood, designed according to the invention, that at least partially surrounds the drying cylinder.

Furthermore, the invention relates to the use of a drying hood according to the invention in a drying arrangement for drying a fibrous web such as a tissue paper web.

Finally, the invention relates to a machine for producing or treating a fibrous web, comprising a drying hood according to the invention or a corresponding drying arrangement with a drying hood.

BRIEF DESCRIPTION OF THE SEVERAL VIEWS OF THE DRAWING

The invention is explained in greater detail below with reference to the drawings, in terms of a preferred exemplary embodiment, without restricting the invention's generality. The drawings show the following.

DESCRIPTION OF THE INVENTION

Figure 1:
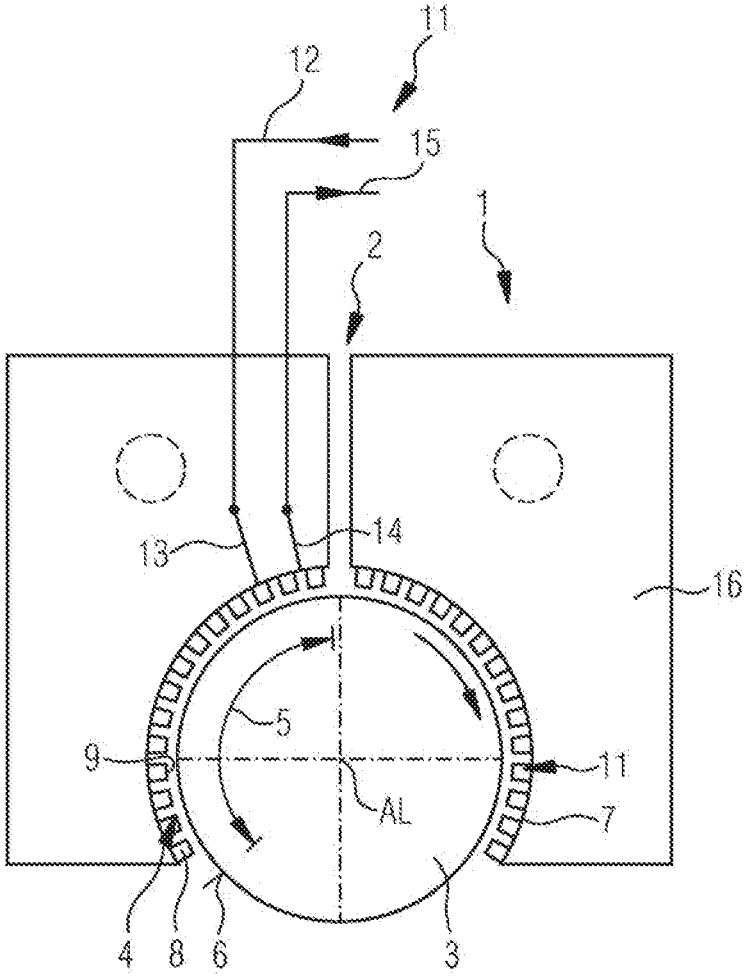
FIG. 1 a schematic side view of a drying arrangement comprising a drying hood and a drying cylinder, FIG. 2 a schematic drawing of a bearing arrangement according to one exemplary embodiment of the invention, FIG. 3 a partially cut-away view of an exemplary embodiment of a nozzle box designed according to the invention along the longitudinal axis thereof, and FIGS. 4*a*, 4*b* structural detail views of the nozzle box shown in FIG. 3 as seen in the direction of the longitudinal axis L.

FIG. 1 shows a schematized simplified representation of a drying arrangement 1 for use in a machine for manufacturing or treating a material web, in particular a fibrous web in the form of a paper, cardboard or tissue web.

The drying arrangement 1 is shown as installed in the machine in a side view in with the viewing direction toward the rotation axis AL of a drying cylinder 3. In the illustration, the rotation axis AL runs perpendicularly into the drawing plane.

Depending on the design of the drying arrangement 1, the drying cylinder 3 may be designed as a heatable cylinder with a closed surface or—not shown here—as a suction-capable cylinder. In the direction of rotation of the drying cylinder 3 (indicated here by the arrow), the fibrous web to be dried is carried along the drying cylinder's outer circumference 6 and fed through the drying arrangement 1. The direction of rotation of the drying cylinder 3 (here clockwise) therefore corresponds to the machine direction, i.e. the longitudinal direction of the fibrous web to be dried.

The drying arrangement 1 further comprises at least one drying hood 2 which at least partially encloses the drying cylinder 3 in the circumferential direction. To enable straightforward positioning while enclosing a larger area of the drying cylinder 3 in the circumferential direction, the drying hood 2 is designed in two parts. In principle, the drying hood 2 may be a gas-heated creping cylinder hood.

The drying hood 2 comprises a plurality of nozzle boxes 8. These nozzle boxes comprise a wall and, together with the outer circumference 6 of the drying cylinder 3, define a gap 4 over at least a part 5 of the cylinder's outer circumference 6. Each nozzle box 8 has a multiplicity of outlet openings 9 for discharging air to dry the fibrous web, i.e. discharging the air toward the outer circumference 6 of the drying cylinder 3. The nozzle boxes 8 arranged in the circumferential direction around the axis of rotation AL of the drying cylinder 3 thus run parallel to each other and parallel to the axis of rotation AL with regard to their longitudinal axes. They may be arranged so that their longitudinal axes lie on a circumference around the drying cylinder 3 that has a greater diameter than the drying cylinder 3 itself. The longitudinal axes run parallel to the machine transverse direction, i.e. the width direction of the fibrous web. The length of the nozzle boxes 8 is such that they extend at least over the entire width direction of the fibrous web.

In this case, adjacent nozzle boxes 8 form intermediate spaces that act as suction openings 7. Via these openings, moist exhaust air may be fed out of the interior of the drying hood 2.

An air routing system 11, for feeding supply air to the drying hood 2 and removing exhaust air from it, is associated with the drying hood 2. This system may be a part of the drying arrangement 1. The air routing system 11 has at least one supply duct 12 for carrying the (hot and comparatively dry) supply air, and this duct is connected to the individual nozzle boxes 8 in a flow-conducting manner via corresponding distribution ducts, one of which designated as 13 here by way of example. Thus at least one individual distribution channel 13 may be associated with each nozzle box 8. Via the suction openings 7 arranged between or formed by the nozzle ducts 8, moisture-laden exhaust air is discharged from the drying hood 2, or more precisely (in part) from the gap 4 that the suction openings and the outer surface of the drying cylinder 3 delimit. For this purpose, the individual suction openings 7 are connected in a flow-conducting manner to an exhaust duct 15 via individual suction ducts associated with them, one of which is designated as 14 by way of example. The exhaust air (which is more humid than the supply air) is conveyed out of the drying hood 2 via the exhaust duct 15 via the suction openings 7. The suction openings 7 and outlet openings 9 may extend over the entire length of the respective nozzle boxes 8. The drying hood 2 or the drying arrangement are associated with corresponding devices (for example blowers, exhaust systems, heaters), not shown here, for conveying and preparing the air.

The drying hood 2 forms a housing 16 that houses the components shown. Thus, the housing here partially surrounds the nozzle boxes 8. These nozzle boxes are suspended on the housing 16. When the drying arrangement 1 is operating, the nozzle boxes 8 are subjected to different temperatures due to the supply and exhaust air. This may lead to locally different thermal expansions. Stresses and displacements of the nozzle boxes 8 result, which the housing 16 of the drying hood 2 must absorb.

Figure 2:
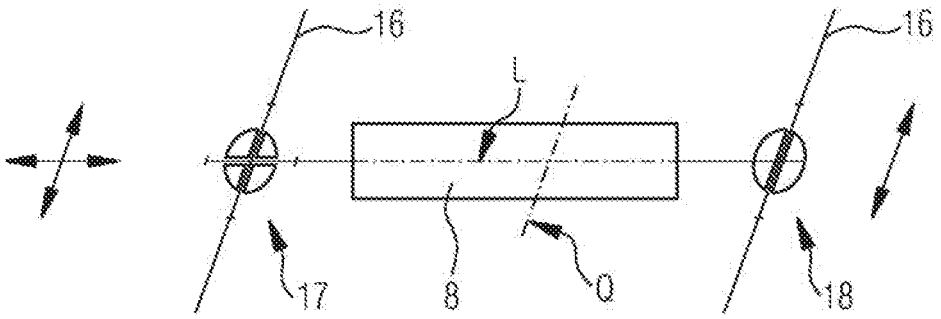

For that purpose, according to one embodiment of the invention, the nozzle boxes 8 are specially mounted. FIG. 2 shows, by way of example, another embodiment of a basic bearing arrangement for a single nozzle box 8.

The nozzle box 8 is mounted on the housing 16 by two bearings 17, 18. The bearings 17, 18 are arranged here in the area of the axial ends of the nozzle box 8—viewed from the longitudinal axis L thereof. The first bearing 17 here is designed in such a way that it allows the nozzle box 8 to move relative to the housing 16 along both the longitudinal axis L and a transverse axis Q of the nozzle box 8, the transverse axis being perpendicular to the longitudinal axis. In contrast, the second bearing 18 is arranged in such a way as to allow only a relative movement of the nozzle box 8 relative to the housing 16 along the transverse axis Q (or along a line parallel to that axis). Thus, the two bearings 17, 18 differ by one with regard to their translational degrees of freedom: The first bearing 17 enables two such translational degrees of freedom, while the second bearing 18 allows only one. The representation of the first bearing 17 by quarter circles is intended to indicate that it has the corresponding two translational degrees of freedom. The representation of the second bearing 18 by semicircles is intended to indicate, in contrast, that this bearing only permits one translational degree of freedom. The lines above and below the two bearings 17, 18 indicate stops that limit the corresponding linear movement along the direction shown. Such a limitation may be realized in the exemplary embodiment in relation to the representation of FIGS. 4*a* and 4*b*, which will be discussed later, by the contour of the groove 21—here, for example, by the end areas of the groove 21: The bolt 19 that engages in the groove 21, in its movement along the transverse direction Q, is prevented by the contour of the groove 21 on both sides from moving laterally outside the contour of the groove 21.

Figure 3:
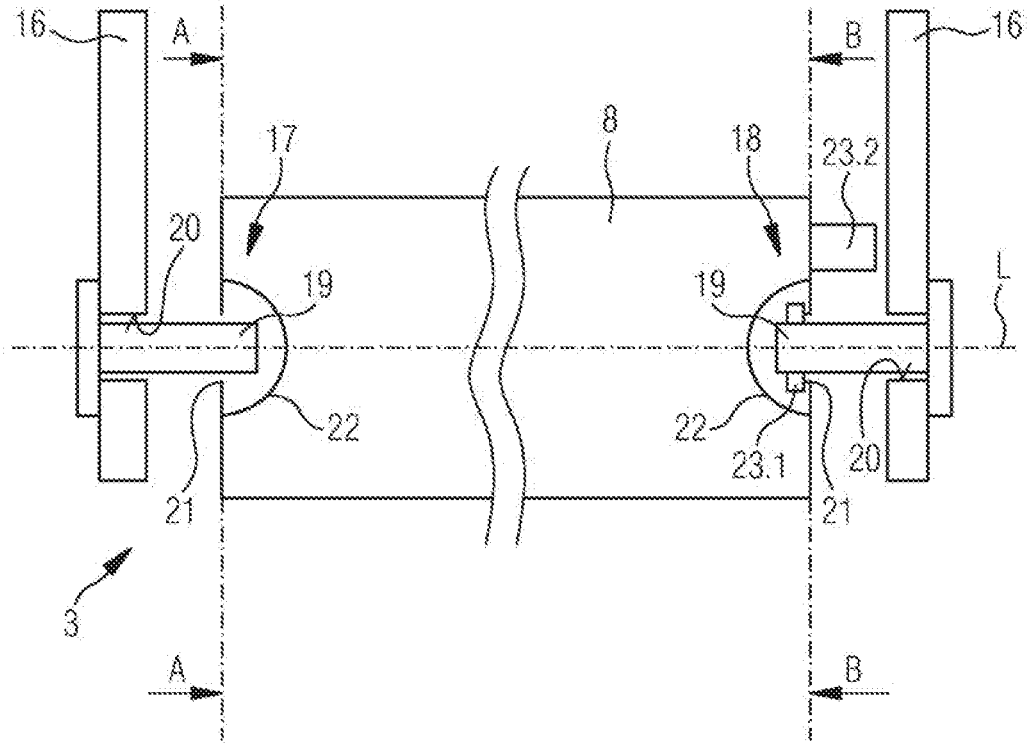

FIG. 3 shows a schematic and not-to-scale representation of a partially cut-away embodiment of a drying arrangement 1 according to the invention. The diagram shows the two respective axial ends of a nozzle box 8, and the box's suspension on the housing 16 of the drying hood 2. The underlying principle of the arrangement of FIG. 3 corresponds to the bearing arrangement of FIG. 2.

Both bearings 17, 18 are designed here as a kind of guide rail. An opening 20 is furnished in the housing 16 of the drying hood 2, more precisely in the area of the axial ends of the nozzle box 8. A bolt 19 engages through an opening 20 into a respective groove 21 of the nozzle box 8, namely from outside the housing 16 via the interior of the drying hood 2 enclosed by the housing, into the area of the axial end of the nozzle box 8. The bolts 19 are connected or connectable to the side (outside) of the drying hood 2 that faces away from the nozzle box 8 or to the housing 16, in a nonpositive, positive and/or material fit, preferably by welding. To prevent supply air from escaping at the point where the bolt extends into the nozzle box 8, corresponding seals 22 may be furnished at the respective points on the nozzle box 8.

The at least one groove 21 of at least one of the two bearings 17, 18 could in principle also be formed by the housing 16 of the drying hood 2 and the bolt 19 of the respective nozzle box 8. The groove 21 or the bolt 19 of at least one bearing 17, 18 could likewise be formed from separate elements for the housing 16 or nozzle box 8.

A first linear stop 23.1 and second linear stop 23.2 are furnished in the area of the axial end of the nozzle box 8 at which the second bearing 18 is arranged (shown here on the right). Both of these stops serve to prevent linear movement of the second bearing 18 in the longitudinal direction of the nozzle box 8 and also to set a defined gap between the mutually-facing end faces of housing 16 and nozzle box 8 at the respective axial end of the nozzle box 8. The linear stop 23 prevents the movement of the axial end of the nozzle box 8 in either direction in the area where the second bearing 18 is arranged along the longitudinal axis L. In other words, the second axial bearing 18 prevents the relevant axial end from moving in the direction of the longitudinal axis. In the embodiment shown, the two linear stops 23.1, 23.2 are formed by two separate parts. Thus, the second linear stop 23.2 may be an elevation that is arranged in the gap between the facing axial end faces of nozzle box 8 and housing 16, and is preferably fastened to the nozzle box 8 or designed integrally therewith. In addition, the first linear stop 23.1 may serve as a counter stop that is connected to the bolt 19 (or may be designed integrally with the bolt) and is supported on the nozzle box 8 in such a way that the stop prevents the nozzle box from moving in an opposite direction along its longitudinal axis. Both the counter stop and the elevation may also be connected or (detachably) connectable to the bolt 19. They may be designed integrally with the bolt 19 or the element on which they are arranged. The two linear stops 23.1, 23.2 may thus be part of or associated with the second bearing 18.

Figure 4A:
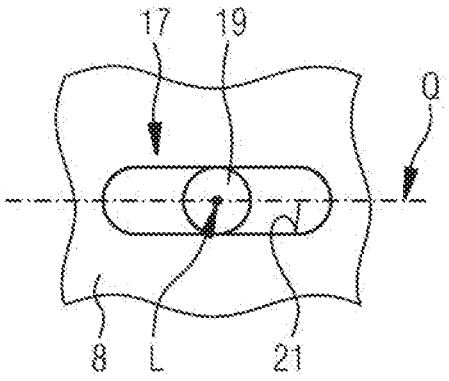
Figure 4B:
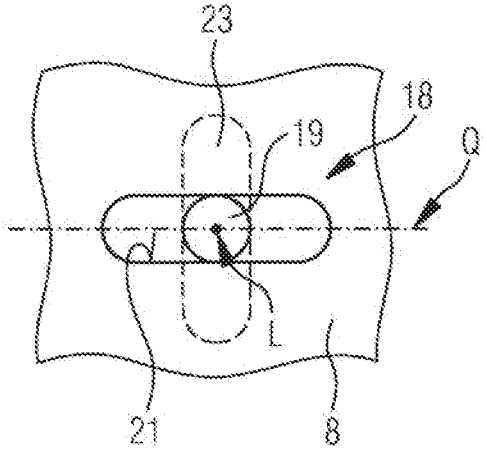

FIGS. 4*a* and 4*b* respectively show a schematic, partially cut-away representation through the two bearings 17, 18 of FIG. 3, viewed perpendicular to the longitudinal axis. FIG. 4*a* shows a section along line A-A in FIG. 3, and FIG. 4*b* shows a section along line B-B in FIG. 3. As may be seen from FIGS. 4*a*, 4*b*, the grooves 21 of the two bearings 17, 18 are designed as longitudinal grooves (linear grooves that bound an oval contour). The longitudinal axis or symmetry axis of the grooves 21 coincides with the transverse axis Q of the corresponding nozzle box 8 (or a line parallel thereto). The bolts 19 have an external shape that is complementary to the contour of the grooves 21, so these bolts they may move along the transverse axis Q in the groove 19, into which they engage when the drying arrangement 1 is operating. Here, the bolts 19 are designed as rotationally symmetrical bodies, i.e. as cylinders. Other shapes—and also other shapes of the grooves 21—would also be possible in principle, as long as they combine to form a guide rail.

Thus, the mutually-facing end faces of the groove 21 and the outer surface of the bolt 19 form corresponding bearing surfaces of the bearing 17, 18. If both bearings 17, 18 are designed as sliding bearings, the bearing surfaces are the sliding surfaces of the sliding bearing.

Thus, according to FIG. 4*a*, the first bearing 17 may be designed in such a way that it has a translational degree of freedom of two, thus allowing the nozzle box 8 to move both in the direction of the longitudinal axis L and the direction of the transverse axis Q.

As indicated by the dashed lines in FIG. 4*b*, the outer contour of the first linear stop 23.1, here the counter stop, is designed in such a way that the stop may be inserted axially into the groove 21 in a first position, and through this groove may be inserted above and behind the wall of the nozzle box 8. By turning the bolt 19 around its longitudinal axis, which here coincides, for example, with the longitudinal axis of the nozzle box 8, the bolt is interlocked with the wall of the nozzle box 8. As a result, the bolt is held securely to the wall of the nozzle box 8 and blocks it from moving along its longitudinal axis. Thus, an opposite movement of the nozzle box 8 toward the first bearing 17 along the longitudinal axis L of the respective nozzle box 8 is prevented in both directions. In the interlocked position shown, the bolt 19 may then be connected to the housing 16 in a nonpositive, positive and/or material fit. The counter stop or generally the first linear stop 23.1 may thus be designed as a (detachable) bayonet joint. To summarize, with this bearing 18, only a single translational degree of freedom may be achieved, namely in the direction of the transverse axis.

LIST OF REFERENCE SIGNS

1 Drying arrangement
2 Drying hood
3 Drying cylinder
4 Gap
5 Part of circumference
6 Outer circumference
7 Suction openings
8 Nozzle boxes
9 Outlet openings
11 Air routing system
12 Supply duct
13 Distribution duct
14 Suction duct
15 Exhaust duct
16 Housing
17 First bearing
18 Second bearing
19 Bolts
20 Opening
21 Groove
22 Seal
23 Linear stop
20 Wall region
21 Support structure
22 Support unit
23 Thermal insulation
AL Rotation axis
L Longitudinal axis
Q Transverse axis

The invention claimed is:

1. A drying hood for drying a fibrous web or a tissue paper web, the drying hood comprising:

a plurality of nozzle boxes for supplying or discharging air, each of said nozzle boxes having a longitudinal axis and a transverse axis being transverse to said longitudinal axis;

a housing at least partially surrounding said nozzle boxes;

first and second bearings, a respective one of said first bearings and a respective one of said second bearings individually mounting each of said nozzle boxes on said housing;

said first and second bearings allowing at least one movement of said nozzle boxes relative to said housing along at least one of said longitudinal axis or said transverse axis; and said first and second bearings having translational degrees of freedom differing from one another by one degree of freedom; and said first and second bearings being linear bearings or pure linear bearings.

2. The drying hood according to claim 1, wherein said first bearings have two translational degrees of freedom, and said second bearings have one translational degree of freedom.

3. The drying hood according to claim 2, wherein said first bearings permit a movement of said nozzle boxes relative to said housing in said longitudinal direction and in said transverse direction, and said second bearings permit a movement of said nozzle boxes relative to said housing in said transverse direction.

4. The drying hood according to claim 2, wherein:

said first bearings are doubly displaceable and are configured to permit displacement of said nozzle boxes relative to said housing along said longitudinal axes of said nozzle boxes and along said transverse axes; and said second bearings are configured to be singly-displaceable bearings allowing displacement of said nozzle boxes relative to said housing along said transverse axis.

5. The drying hood according to claim 1, wherein said nozzle boxes have axial ends, and said first and second bearings mounting a respective one of said nozzle boxes are each disposed in a region of a respective one of said axial ends.

6. The drying hood according to claim 1, wherein said housing and said nozzle boxes have end faces facing each other, and said first and second bearings mounting a respective one of said nozzle boxes are each disposed in a region of a respective one of said end faces.

7. A drying hood for drying a fibrous web or a tissue paper web, the drying hood comprising:

a plurality of nozzle boxes for supplying or discharging air, each of said nozzle boxes having a longitudinal axis and a transverse axis being transverse to said longitudinal axis;

a housing at least partially surrounding said nozzle boxes;

first and second bearings, a respective one of said first bearings and a respective one of said second bearings individually mounting each of said nozzle boxes on said housing;

said first and second bearings allowing at least one movement of said nozzle boxes relative to said housing along at least one of said longitudinal axis or said transverse axis;

said first and second bearings having translational degrees of freedom differing from one another by one degree of freedom; and said first and second bearings each configured as a respective guide rail including a groove and a bolt engaging in said groove, said grooves associated with said housing and said bolts each associated with a respective nozzle box or bounded or formed by said respective nozzle box.

8. The drying hood according to claim 7, wherein each of said bolts has a rotationally symmetrical outer contour, and each of said grooves is a straight longitudinal groove formed to be complementary to said bolt engaging in said longitudinal groove.

9. The drying hood according to claim 7, wherein said bolt of at least one of said first or second bearings has an axial end facing said housing and being connected to or connectable to said housing by a force-locking, form-locking or material connection.

10. The drying hood according to claim 9, wherein said bolt of at least one of said first or second bearings has an axial end facing a respective one of said nozzle boxes and engaging said groove associated with said respective one of said nozzle boxes.

11. A drying hood for drying a fibrous web or a tissue paper web, the drying hood comprising:

a plurality of nozzle boxes for supplying or discharging air, each of said nozzle boxes having a longitudinal axis and a transverse axis being transverse to said longitudinal axis;

a housing at least partially surrounding said nozzle boxes;

first and second bearings, a respective one of said first bearings and a respective one of said second bearings individually mounting each of said nozzle boxes on said housing;

said first and second bearings allowing at least one movement of said nozzle boxes relative to said housing along at least one of said longitudinal axis or said transverse axis;

said first and second bearings having translational degrees of freedom differing from one another by one degree of freedom; and at least one linear stop being associated with or formed by said first bearing and forming a defined gap between end faces of said housing and said nozzle box facing each other.

12. A drying hood for drying a fibrous web or a tissue paper web, the drying hood comprising:

a plurality of nozzle boxes for supplying or discharging air, each of said nozzle boxes having a longitudinal axis and a transverse axis being transverse to said longitudinal axis;

a housing at least partially surrounding said nozzle boxes;

first and second bearings, a respective one of said first bearings and a respective one of said second bearings individually mounting each of said nozzle boxes on said housing;

said first and second bearings allowing at least one movement of said nozzle boxes relative to said housing along at least one of said longitudinal axis or said transverse axis;

said first and second bearings having translational degrees of freedom differing from one another by one degree of freedom; and said first and second bearings being sliding bearings.

13. A drying arrangement for drying a fibrous web or a tissue paper web, the drying arrangement comprising:

a drying cylinder; and a drying hood according to claim 1 at least partially surrounding said drying cylinder.

14. The drying arrangement according to claim 13, wherein said drying cylinder has an outer circumference, and said plurality of nozzle boxes is disposed around said drying cylinder over at least a part of said outer circumference.

15. The drying arrangement according to claim 13, wherein said drying cylinder is heated or is configured to be heated.

16. The drying arrangement according to claim 15, wherein said drying cylinder is a Yankee cylinder.

17. A method for drying a fibrous web or a tissue paper web, the method comprising the step of using the drying hood according to claim 1 to dry the fibrous web or the tissue paper web.

18. A method for drying a fibrous web or a tissue paper web, the method comprising the step of using the drying hood of the drying arrangement according to claim 13 to dry the fibrous web or the tissue paper web.

* * * * *